US011352582B2

(12) United States Patent
Kassir et al.

(10) Patent No.: US 11,352,582 B2
(45) **Date of Patent: *Jun. 7, 2022**

(54) LUBRICANT WITH HIGH PYROPHOSPHATE LEVEL

(71) Applicant: The Lubrizol Corporation, Wickliffe, OH (US)

(72) Inventors: Jamal Kassir, Dearborn, MI (US); William R. S. Barton, Belper (GB); Paul E. Adams, Willoughby, OH (US); Lisa Blanazs, Mannheim (DE)

(73) Assignee: The Lubrizol Corporation, Wickliffe, OH (US)

( * ) Notice: Subject to any disclaimer, the term of this patent is extended or adjusted under 35 U.S.C. 154(b) by 310 days.

This patent is subject to a terminal disclaimer.

(21) Appl. No.: 15/773,605

(22) PCT Filed: Oct. 27, 2016

(86) PCT No.: PCT/US2016/059000

§ 371 (c)(1),
(2) Date: May 4, 2018

(87) PCT Pub. No.: WO2017/079016

PCT Pub. Date: May 11, 2017

(65) Prior Publication Data

US 2019/0078035 A1 Mar. 14, 2019

Related U.S. Application Data

(60) Provisional application No. 62/251,897, filed on Nov. 6, 2015.

(51) Int. Cl.

| | |
|---|---|
| ***C10M 141/10*** | (2006.01) |
| ***C10M 169/04*** | (2006.01) |
| ***C10M 137/08*** | (2006.01) |
| ***C10M 107/02*** | (2006.01) |
| ***C10M 129/56*** | (2006.01) |
| ***C10M 135/36*** | (2006.01) |
| *C10N 10/04* | (2006.01) |
| *C10N 20/02* | (2006.01) |
| *C10N 30/02* | (2006.01) |
| *C10N 30/04* | (2006.01) |
| *C10N 30/06* | (2006.01) |
| *C10N 30/12* | (2006.01) |
| *C10N 30/00* | (2006.01) |
| *C10N 40/04* | (2006.01) |
| *C10N 70/00* | (2006.01) |

(52) U.S. Cl.

CPC ..... *C10M 169/04* (2013.01); *C10M 107/02* (2013.01); *C10M 129/56* (2013.01); *C10M 135/36* (2013.01); *C10M 137/08* (2013.01); *C10M 141/10* (2013.01); *C10M 2203/10* (2013.01); *C10M 2205/0206* (2013.01); *C10M 2205/0285* (2013.01); *C10M 2207/26* (2013.01); *C10M 2215/224* (2013.01); *C10M 2215/28* (2013.01); *C10M 2219/022* (2013.01); *C10M 2219/106* (2013.01); *C10M 2223/043* (2013.01); *C10N 2010/04* (2013.01); *C10N 2020/02* (2013.01); *C10N 2030/02* (2013.01); *C10N 2030/04* (2013.01); *C10N 2030/06* (2013.01); *C10N 2030/12* (2013.01); *C10N 2030/42* (2020.05); *C10N 2030/43* (2020.05); *C10N 2040/04* (2013.01); *C10N 2040/044* (2020.05); *C10N 2070/00* (2013.01)

(58) Field of Classification Search

CPC ..... C10M 141/10; C10M 135/36; C10M 129/56; C10M 107/02; C10M 137/08; C10M 2215/224; C10M 2215/28; C10M 2219/022; C10M 2207/26; C10M 2205/0206; C10M 2223/043; C10M 2219/106; C10M 2205/0285; C10M 2203/10; C10N 2270/00; C10N 2230/12; C10N 2230/04; C10N 2230/43; C10N 2230/42; C10N 2230/06; C10N 2210/02

USPC ..... 508/272

See application file for complete search history.

(56) References Cited

U.S. PATENT DOCUMENTS

| | | | |
|---|---|---|---|
| 2,664,400 | A | 12/1953 | Woodstock |
| 2,848,414 | A | 8/1958 | Chenicek |
| 2,961,408 | A | 11/1960 | Havely et al. |

(Continued)

FOREIGN PATENT DOCUMENTS

| | | |
|---|---|---|
| EP | 355895 | 1/1991 |
| WO | 056968 | 8/2001 |

(Continued)

OTHER PUBLICATIONS

David A. Jaeger et al., "Pyrophosphate-Based Gemini Surfactants", Langmuir, vol. 18, No. 24, Nov. 1, 2002, pp. 9259-9266.

Martin J.P. Harger, "Phosphoramidic Acid Monoesters As Phosphorylating Agents: Steric Effects and Reluctance to Form Monomeric Metaphosphate Intermediates", Chemical Communications—Chemcom., No. 17, Jan. 1, 2004, p. 1952.

(Continued)

*Primary Examiner* — Prem G Singh
*Assistant Examiner* — Francis C Campanell
(74) *Attorney, Agent, or Firm* — Michael Miller

(57) ABSTRACT

A lubricant composition comprising an oil of lubricating viscosity and 0.01 to 5 percent by weight of a substantially sulfur-free alkyl phosphate amine salt, where at least 30 mole percent of the phosphorus atoms are in an alkyl pyrophosphate salt structure, exhibits good antiwear performance. In the phosphate amine salt, at least 80 mole percent of the alkyl groups are typically secondary alkyl groups of 3 to 12 carbon atoms.

24 Claims, No Drawings

(56) References Cited

U.S. PATENT DOCUMENTS

| | | | | |
|---|---|---|---|---|
| 3,172,892 | A | 3/1965 | Le Suer et al. | |
| 3,354,189 | A * | 11/1967 | Revukas | C10L 1/301 556/17 |
| 3,372,116 | A | 3/1968 | Meinhardt | |
| 3,381,022 | A | 4/1968 | Le Suer | |
| 3,471,404 | A | 10/1969 | Myers | |
| 3,634,515 | A | 1/1972 | Piasek et al. | |
| 4,191,659 | A | 3/1980 | Davis | |
| 4,234,435 | A | 11/1980 | Meinhardt et al. | |
| 4,285,822 | A | 8/1981 | Devries et al. | |
| 4,654,403 | A | 3/1987 | Tipton | |
| 4,719,023 | A | 1/1988 | MacPhail et al. | |
| 4,792,410 | A | 12/1988 | Schwind et al. | |
| 5,110,488 | A | 5/1992 | Tipton et al. | |
| 5,157,088 | A | 10/1992 | Dishong et al. | |
| 5,256,752 | A | 10/1993 | Dishong et al. | |
| 5,395,539 | A | 3/1995 | Chandler et al. | |
| 5,484,543 | A | 1/1996 | Chandler et al. | |
| 6,200,936 | B1 | 3/2001 | Moreton | |
| 6,310,009 | B1 | 10/2001 | Kocsis et al. | |
| 6,310,011 | B1 | 10/2001 | Karn et al. | |
| 6,559,105 | B2 | 5/2003 | Abraham et al. | |
| 6,569,818 | B2 | 5/2003 | Nakazato et al. | |
| 6,660,695 | B2 | 12/2003 | Watts et al. | |
| 7,122,508 | B2 | 10/2006 | Boffa | |
| 7,407,919 | B2 | 8/2008 | Wilk et al. | |
| 8,071,518 | B2 | 12/2011 | Yagishita et al. | |
| 8,349,778 | B2 | 1/2013 | Guinther et al. | |
| 9,050,976 | B2 | 6/2015 | Krauss et al. | |
| 9,382,275 | B2 | 7/2016 | Knapton et al. | |
| 2008/0020952 | A1 | 1/2008 | Yagishita | |
| 2010/0105585 | A1 | 4/2010 | Carey et al. | |
| 2011/0187216 | A1 | 8/2011 | Khan | |
| 2012/0208731 | A1 * | 8/2012 | Lann | C10M 129/72 508/187 |
| 2013/0133243 | A1 | 5/2013 | Roeger-Goepfert et al. | |
| 2013/0252864 | A1 * | 9/2013 | Knapton | C07F 9/09 508/425 |
| 2014/0057818 | A1 | 2/2014 | Barton et al. | |
| 2015/0027958 | A1 | 1/2015 | Tarrant | |
| 2020/0048573 | A1 * | 2/2020 | Filippini | C10M 139/00 |

FOREIGN PATENT DOCUMENTS

| | | |
|---|---|---|
| WO | 0079413 | 8/2006 |
| WO | 094759 | 8/2008 |
| WO | 0077630 | 7/2010 |
| WO | 030590 | 3/2012 |
| WO | 2012/177529 A1 | 12/2012 |
| WO | 0079016 | 5/2017 |
| WO | 017454 | 1/2018 |

OTHER PUBLICATIONS

Rihua Wang, Chemical Abstracts Service, Columbus, Ohio, "Study on AEP-Water Soluble EP Additives", vol. 3, Dec. 31, 1994, pp. 17-18.

Yi-Fei et al., PetroChina Dalian Lubricating Oil R&D Institute, Dalian 116032, China, Synthesis Of Primene Amine Pyrophosphate EP Antiwear Agent And Investigation Of Its Performance, PN 181488, Jul. 2011, vol. 26, No. S1, Article ID: 1002-3119, (2011) S1-0053-04, pp. 53.59.

* cited by examiner

LUBRICANT WITH HIGH PYROPHOSPHATE LEVEL

CROSS REFERENCE TO RELATED APPLICATION

This application claims priority from PCT Application Serial No. PCT/US2016/059000 filed on Oct. 27, 2016, which claims the benefit of U.S. Provisional Application No. 62/251,897 filed on Nov. 6, 2015, both of which are incorporated in their entirety by reference herein.

BACKGROUND

The disclosed technology relates to lubricants containing a phosphorus composition which provide good wear protection in lubricating, for example, gears.

Driveline power transmitting devices (such as gears or transmissions, especially axle fluids and manual transmission fluids (MTFs)) and grease applications, present highly challenging technological problems and solutions for satisfying the multiple and often conflicting lubricating requirements, while providing durability and cleanliness.

The development of new antiwear chemistry for such applications as gear oils has been driven by the desire to provide chemistries that meet modern lubricating requirements, provide thermo-oxidative stability and cleanliness, and have non-objectionable odor. Many current phosphorus antiwear or extreme pressure additives contain sulfur. Due to increasing environmental concerns, the presence of sulfur in antiwear or extreme pressure additives is becoming less desirable. In addition, many of the sulfur-containing antiwear or extreme pressure additives evolve volatile sulfur species, resulting in lubricating compositions containing antiwear or extreme pressure additives having an odor, which may also be detrimental to the environment or evolve emissions that may be higher than increasingly tighter health and safety legislation specifies. Moreover, it is desirable to provide antiwear chemistry that provides good performance at low levels of phosphorus and/or which performs well in low viscosity lubricant formulations. It is also desirable to have a lubricant or additive therefor which has an acceptable appearance, that is, without haze or objectionable color; the final lubricant may ideally be clear or homogenous. The disclosed technology provides one or more of the above advantages.

PCT Publication WO 2008/094759, Aug. 7, 2008, reports a lubricating composition of an oil of lubricating viscosity and a sulfur-free amine salt of either (i) a hydroxyl-substituted diester of phosphoric acid, or (ii) a phosphorylated hydroxy-substituted di- or triester of phosphoric acid. In one embodiment, the salt of a hydroxy-substituted diester of phosphoric acid may be prepared by a process comprising (i) reacting a phosphorylating agent with an alcohol, to form a mono- and/or diphosphate ester; reacting the phosphate ester with an alkylene oxide, to form a hydroxy-substituted diester of phosphoric acid; and salting the hydroxy-substituted diester of phosphoric acid with an amine and/or metal.

U.S. Application 2004/0087450, Boffa, May 6, 2004, discloses methods and compositions for reducing wear in internal combustion engines lubricated with a low phosphorous content borate-containing lubricating oil. One disclosed structure is

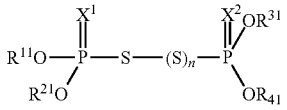

Examples of the R groups include, among others, 4-methyl-2-pentyl. Another class of oil-soluble, phosphorus-containing anti-wear additives includes amine phosphates, including commercially available monobasic hydrocarbyl amine salts of mixed mono and di-acid phosphates

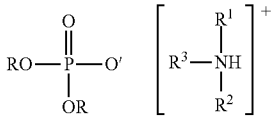

U.S. Publication 2009/0048131, Guinther, Feb. 19, 2009, discloses an additive composition comprising (a) at least one ash-containing phosphorus compound and (b) a salt of at least one hydrocarbylamine and at least one hydrocarbyl acid phosphate. The ash-free phosphorus compound may be prepared from phosphoric acid esters of the formula

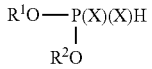

where X is O or S and $R^1$ can be hydrogen or a hydrocarbyl group and $R^2$ can be a hydrocarbyl group, prepared from ROH. In one aspect ROH can be a secondary aliphatic alcohol containing at least about 4 carbon atoms, e.g., isopropanol, isooctanol, 2-butanol, and methyl isobutyl carbinol (4-methyl-2-pentane-2-ol).

U.S. Application 3008/0020952, Yagishita, Jan. 24, 2008, discloses lubricant compositions containing organomolybdenum compounds and, optionally, an antiwear agent other than zinc dithiophosphate. The antiwear agent may be of the structure

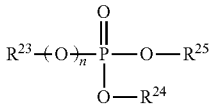

where the Rs are hydrogen or hydrocarbon radicals of carbon number 1 to 30. The antiwear agent can be a metal salt or an amine salt. (The R groups may be the same as $R^9$ and $R^{10}$, which are elsewhere described as being straight-chain type or branching type.)

U.S. Application 2011/0187216, Khan, Aug. 4, 2011, discloses a lubricating fluid for a disc drive spindle motor. The lubricating fluid comprises a synthetic ester base fluid, a conductivity inducing agent, an antioxidant, and 0.01 to 5% by weight of at least one antiwear additive, which may include, among others, salts of alkylphosphoric acids, neutral phosphate esters, e.g., amine salts of an acid phosphate such as $Cu_{11}$-$C_{14}$ branched alkyl phosphates. Various phosphate triesters are also named, with various linear or branched alkyl groups.

U.S. Application 2009/0075852, Yagishita et al., Mar. 19, 2009, discloses a low ash engine oil composition containing a sulfur-free phosphorus compound. The phosphorus compound may contain a hydrocarbyl group of 1 to 30 carbon atoms, which may be straight chained or branched and may be primary, secondary, or tertiary. An example is zinc di-n-butylphosphate.

SUMMARY

The disclosed technology provides a lubricant composition comprising an oil of lubricating viscosity and about 0.01 to about 5 percent by weight of a substantially sulfur-free alkyl phosphate amine salt wherein at least about 30 mole percent of the phosphorus atoms are in an alkyl pyrophosphate salt structure; wherein at least about 80 mole percent of the alkyl groups of the phosphate structure are secondary alkyl groups of about 3 to about 12 carbon atoms.

The disclosed technology also provides a method of preparing a substantially sulfur-free alkyl phosphate amine salt wherein at least 30 mole percent of the phosphorus atoms are in an alkyl pyrophosphate salt structure, comprising: reacting phosphorus pentoxide with about an equivalent amount of a secondary alcohol or a mixture of secondary alcohols having 4 to 12 carbon atoms, at a temperature of 40 to 60° C., and reacting the product thereof with an amine.

The disclosed technology also provides a method of lubricating a gear comprising supplying thereto the lubricant composition as set forth herein.

DETAILED DESCRIPTION

Various preferred features and embodiments will be described below by way of non-limiting illustration.

Oil of Lubricating Viscosity

One component of the disclosed technology is an oil of lubricating viscosity, also referred to as a base oil. The base oil may be selected from any of the base oils in Groups I-V of the American Petroleum Institute (API) Base Oil Interchangeability Guidelines (2011), namely

| Base Oil Category | Sulfur (%) | Saturates (%) | Viscosity Index |
|---|---|---|---|
| Group I | >0.03 and/or | <90 | 80 to less than 120 |
| Group II | ≤0.03 and | ≥90 | 80 to less than 120 |
| Group III | ≤0.03 and | ≥90 | ≥120 |
| Group IV | All polyalphaolefins (PAOs) | | |
| Group V | All others not included in Groups I, II, III or IV | | |

Groups I, II and III are mineral oil base stocks. Other generally recognized categories of base oils may be used, even if not officially identified by the API: Group II+, referring to materials of Group II having a viscosity index of 110-119 and lower volatility than other Group II oils; and Group III+, referring to materials of Group III having a viscosity index greater than or equal to 130. The oil of lubricating viscosity can include natural or synthetic oils and mixtures thereof. Mixture of mineral oil and synthetic oils, e.g., polyalphaolefin oils and/or polyester oils, may be used.

In one embodiment the oil of lubricating viscosity has a kinematic viscosity at 100° C. by ASTM D445 of 3 to 7.5, or 3.6 to 6, or 3.5 to 6, or 3.5 to 5 $mm^2/s$. In one embodiment the oil of lubricating viscosity comprises a poly alpha olefin having a kinematic viscosity at 100° C. by ASTM D445 of 3 to 7.5 or any of the other aforementioned ranges.

Phosphate Amine Salt

The lubricant of the disclosed technology will include a substantially sulfur-free alkyl phosphate amine salt, as further described. In this salt composition, at least 30 mole percent of the phosphorus atoms are in an alkyl pyrophosphate structure, as opposed to an orthophosphate (or monomeric phosphate) structure. The percentage of phosphorus atoms in the pyrophosphate structure may be 30 to 100 mole %, or 40 to 90% or 50 to 80% or 55 to 70% or 55 to 65%. The remaining amount of the phosphorus atoms may be in an orthophosphate structure or may consist, in part, in unreacted phosphorus acid or other phosphorus species. In one embodiment, up to 60 or up to 50 mole percent of the phosphorus atoms are in mono- or di-alkyl-orthophosphate salt structure.

The substantially sulfur-free alkyl phosphate amine salt, as present in the pyrophosphate form (sometimes referred to as the POP structure), may be represented in part by the following formulas (I) and/or (II):

(I)

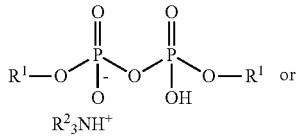

or (II)

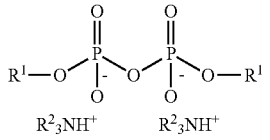

Formula (I) represents a half-neutralized phosphorus salt; formula (II) a fully neutralized salt. It is believed that both of the two hydroxy hydrogen atoms of the first-formed phosphate structure are sufficiently acidic to be neutralized by an amine, so that formula (II) may predominate if a stoichiometrically sufficient amount of amine is present. The extent of neutralization in practice, that is, the degree of salting of the —OH groups of the phosphorus esters, may be 50% to 100%, or 80% to 99%, or 90% to 98%, or 93% to 97%, or about 95%, which may be determined or calculated on the basis of the amount of amine charged to the phosphate ester mixture. Variants of these materials may also be present, such as a variant of formula (I) or formula (II) wherein the —OH group (in (I) is replaced by another —OR group or wherein one or more —OR groups are replaced by —OH groups, or wherein an $R^1$ group is replaced by a phosphorus-containing group, that is, those comprising a third phosphorus structure in place of a terminal $R^1$ group. Illustrative variant structures may include the following:

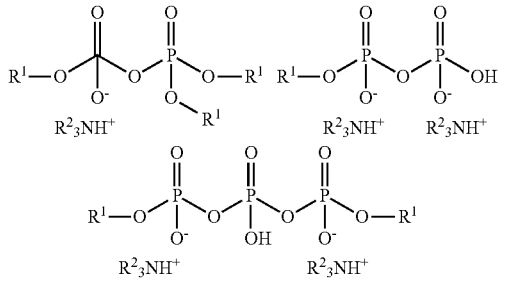

The structures of formulas (I) and (II) are shown as entirely sulfur-free species, in that the phosphorus atoms are bonded to oxygen, rather than sulfur atoms. However, it is possible that a small molar fraction of the 0 atoms could be replaced by S atoms, such as 0 to 5 percent or 0.1 to 4 percent or 0.2 to 3 percent or 0.5 to 2 percent.

These pyrophosphate salts may be distinguished from orthophosphate salts of the general structure

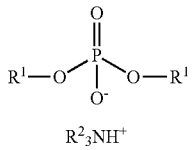

which optionally may also be present in amounts as indicated above.

In formulas (I) and (II), each $R^1$ is independently an alkyl group of 3 to 12 carbon atoms. In certain embodiments at least 80 mole percent, or at least 85, 90, 95, or 99 percent, of the alkyl groups will be secondary alkyl groups. In some embodiments the alkyl groups will have 4 to 12 carbon atoms, or 5 to 10, or 6 to 8 carbon atoms. Such groups include 2-butyl, 2-pentyl, 3-pentyl, 3-methyl-2-butyl, 2-hexyl, 3-hexyl, cyclohexyl, 4-methyl-2-pentyl, and other such secondary groups and isomers thereof having 6, 7, 8, 9, 10, 11, or 12 carbon atoms. In some embodiments the alkyl group will have a methyl branch at the α-position of the group, an example being the 4-methyl-2-pentyl (also referred to as 4-methylpent-2-yl) group.

Such alkyl (including cycloalkyl) groups will typically be provided by the reaction of the corresponding alcohol or alcohols with phosphorus pentoxide (taken herein to be $P_2O_5$ although it is recognized the more probable structure may be represented by $P_4O_{10}$). Typically 2 to 3.1 moles of alcohol will be provided per mole of $P_2O_5$ to provide a mixture of partial esters including mono- and diesters of the orthophosphate structure and diesters of the pyrophosphate structure:

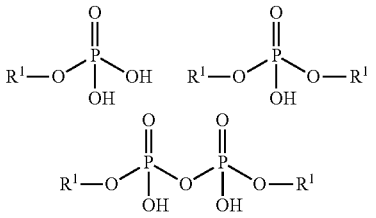

In certain embodiments 2.5 to 3 moles of alcohol may be provided per mole of $P_2O_5$, or 2.2 to 2.8 moles/mole, or even 2.2 to 2.4 moles/mole. The 2.5 to 3 (or 2.2-2.8 or 2.2-2.4) moles of alcohol typically may be made available to react with the $P_2O_5$ (i.e., included in the reaction mixture) but normally the actual reaction will consume less than 3 moles/mole. Thus the alkyl phosphate amine salt may be prepared by the reaction of phosphorus pentoxide with a secondary alcohol having 4 to 12 carbon atoms, and reacting the product thereof with an amine, as described in further detail below.

Reaction conditions and reactants may be selected which will favor formation of the esters of the pyrophosphate structure and will relatively disfavor formation of the orthophosphate mono- and di-esters. The use of secondary alcohols, rather than primary alcohols, is found to favor formation of the pyrophosphate structure. Favorable synthesis temperatures include 30 to 60° C. or 35 to 50° C. or 40 to 50° C. or 30 to 40° C., or about 35° C., and in some embodiments the temperature of reaction may be 50-60° C. Subsequent heating at 60 to 80° C. or about 70° C. after the initial mixing of components may be desirable. It may be desirable to avoid over-heating the reaction mixture or to discontinue heating once the reaction is substantially complete, particularly if the temperature is 60° C. or above; this will be apparent to the person skilled in the art. In certain embodiments the reaction temperature will not exceed 62° C. or 61° C. or 60° C. Favorable conditions may also include exclusion of extraneous water. The progress of the reaction and the relative amounts of the various phosphorus species may be determined by spectroscopic means known to those skilled in the art, including infrared spectroscopy and $^{31}P$ or $^{1}H$ NMR spectroscopy.

While the pyrophosphate ester may be isolated, if desired, from the orthoesters, it is also possible, and may be commercially preferable, to use the reaction mixture without separation of the components.

Amine Component

The pyrophosphate phosphate ester or mixture of phosphate esters with be reacted with an amine to form an amine salt. The amine may be represented by $R^2{}_3N$, where each $R^2$ is independently hydrogen or a hydrocarbyl group or an ester-containing group, or an ether-containing group, provided that at least one $R^2$ group is a hydrocarbyl group or an ester-containing group or an ether-containing group (that is, not NH3). Suitable hydrocarbyl amines include primary amines having 1 to 18 carbon atoms, or 3 to 12, or 4 to 10 carbon atoms, such as methylamine, ethylamine, propylamine, isopropylamine, butylamine and isomers thereof, pentylamine and isomers thereof, hexylamine and isomers thereof, heptylamine and isomers thereof, octylamine and isomers thereof such as isooctylamine and 2-ethylhexylamine, as well as higher amines. Other primary amines include dodecylamine, fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen® C, Armeen® O, Armeen® OL, Armeen® T, Armeen® HT, Armeen® S and Armeen® SD, wherein the letter designation relates to the fatty group, such as coco, oleyl, tallow, or stearyl groups.

Secondary amines that may be used include dimethylamine, diethylamine, dipropylamine, dibutylamine, diamylamine, dihexylamine, diheptylamine, methylethyl-amine, ethylbutylamine, bis-2-ethylhexylamine, N-methyl-1-aminocyclohexane, Armeen® 2C, and ethylamylamine. The secondary amines may be cyclic amines such as piperidine, piperazine and morpholine.

Suitable tertiary amines include tri-n-butylamine, tri-n-octylamine, tri-decylamine, tri-laurylamine, tri-hexadecylamine, and dimethyloleylamine (Armeen® DMOD). Triisodecylamine or tridecylamine and isomers thereof may be used.

Examples of mixtures of amines include (i) an amine with 11 to 14 carbon atoms on tertiary alkyl primary groups, (ii) an amine with 14 to 18 carbon atoms on tertiary alkyl primary groups, or (iii) an amine with 18 to 22 carbon atoms on tertiary alkyl primary groups. Other examples of tertiary alkyl primary amines include tert-butylamine, tert-hexylamine, tert-octylamine (such as 1,1-dimethylhexylamine), tert-decylamine (such as 1,1-dimethyloctylamine), tertdodecylamine, tert-tetradecylamine, tert-hexadecylamine, tertoctadecylamine, tert-tetracosanylamine, and tert-octacosanylamine. In one embodiment a useful mixture of amines includes "Primene® 81R" or "Primene® JMT." Primene® 81R and Primene® JMT (both produced and sold by Rohm & Haas) may be mixtures of C11 to C14 tertiary alkyl primary amines and C18 to C22 tertiary alkyl primary amines, respectively.

Ester-Containing Amines

In other embodiments the amine may be an ester-containing amine such as an N-hydrocarbyl-substituted γ- or δ-amino(thio)ester, which is therefore a secondary amine. One or both of the O atoms of the ester group may be replaced by sulfur, although typically there may be no sulfur atoms. An N-substituted γ-aminoester may be represented by

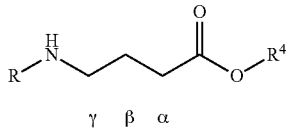

and an N-substituted γ-aminoester may be represented by

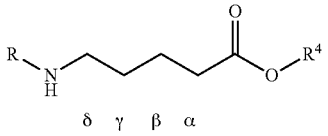

There may also be one or more additional substituents or groups at the α, β, γ, or δ positions of the aminoester. In one embodiment there are no such substituents. In another embodiment there is a substituent at the β position, thus leading to a group of materials represented, in certain embodiments, by the formula

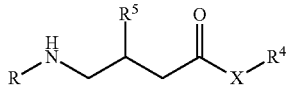

R and $R^4$ are as defined below; X is O or S (in one embodiment, O) and $R^5$ may be hydrogen, a hydrocarbyl group, or a group represented by —C(═O)—$R^6$ where $R^6$ is hydrogen, an alkyl group, or —X'—$R^7$, where X' is O or S and $R^7$ is a hydrocarbyl group of 1 to 30 carbon atoms. That is, a substituent at the β position of the chain may comprise an ester, thioester, carbonyl, or hydrocarbyl group. When $R^5$ is —C(═O)—$R^6$, the structure may be represented by

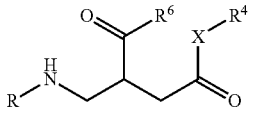

The analogous structures for a δ-amino ester will be understood to be encompassed; this may be, e.g.,

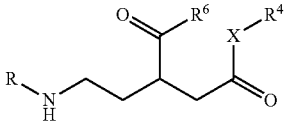

It will be evident that when $R^6$ is —X'—$R^7$ the materials will be substituted succinic acid esters or thioesters. In particular, in one embodiment the material may be a methyl succinic acid diester, with amine substitution on the methyl group. The $R^4$ and $R^7$ groups may be the same or different; in certain embodiments they may independently have 1 to 30 or 1 to 18 carbon atoms, as described below for $R^4$. In certain embodiments, the material may be represented by the structure

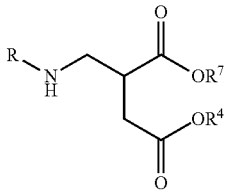

In certain embodiments the material will be or will comprise a 2-((hydrocarbyl)-aminomethyl succinic acid dihydrocarbyl ester (which may also be referred to as a dihydrocarbyl 2-((hydrocarbyl)aminomethyl succinate).

In the above structures, The hydrocarbyl substituent R on the amine nitrogen may comprise a hydrocarbyl group of at least 3 carbon atoms with a branch at the 1 or 2 (that is, α or β) position of the hydrocarbyl chain (not to be confused with the α or β location of the ester group, above). Such a branched hydrocarbyl group R may be represented by the partial formula

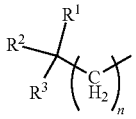

where the bond on the right represents the point of attachment to the nitrogen atom. In this partial structure, n is 0 or 1, $R^1$ is hydrogen or a hydrocarbyl group, $R^2$ and $R^3$ may independently be hydrocarbyl groups or together may form a carboxylic structure. The hydrocarbyl groups may be aliphatic, cycloaliphatic, or aromatic, or mixtures thereof. When n is 0, the branching is at the 1 or α position of the group. When n is 1, the branching is at the 2 or β position. If $R^4$, above, is methyl, then n may in some embodiments be 0.

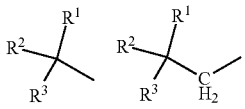

1- or α branching 2- or β branching

There may, of course, be branching both at the 1 position and the 2 position. Attachment to a cyclic structure is to be considered branching:

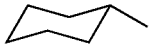

(a type of 1- or α branching)

The branched hydrocarbyl substituent R on the amine nitrogen may thus include such groups as isopropyl, cyclopropyl, sec-butyl, iso-butyl, t-butyl, 1-ethylpropyl, 1,2-dimethylpropyl, neopentyl, cyclohexyl, 4-heptyl, 2-ethyl-1-hexyl (commonly referred to as 2-ethylhexyl), t-octyl (for instance, 1,1-dimethyl-1-hexyl), 4-heptyl, 2-propylheptyl, adamantyl, and α-methylbenzyl.

In the above structures, $R^4$, the alcohol residue portion, may have 1 to 30 or 1 to 18 or 1 to 12 or 2 to 8 carbon atoms. It may be a hydrocarbyl group or a hydrocarbon group. It may be aliphatic, cycloaliphatic, branched aliphatic, or aromatic. In certain embodiments, the $R^4$ group may methyl, ethyl, propyl, isopropyl, n-butyl, iso-butyl, t-butyl, n-hexyl, cyclohexyl, iso-octyl, or 2-ethylhexyl. If $R^4$ is methyl, then the R group, the hydrocarbyl substituent on the nitrogen, may often have a branch at the 1-position. In other embodiments the $R^4$ group may be an ether-containing group. For instance, it may be an ether-containing group or a polyether-containing group which may contain, for instance 2 to 120 carbon atoms along with oxygen atoms representing the ether functionality.

In another embodiment, $R^4$ can be a hydroxy-containing alkyl group or a polyhydroxy-containing alkyl group having 2 to 12 carbon atoms. Such materials may be based on a diol such as ethylene glycol or propylene glycol, one of the hydroxy groups of which may be reacted to form the ester linkage, leaving one unesterified alkyl group. Another example of a material may be glycerin, which, after condensation, may leave one or two hydroxy groups. Other polyhydroxy materials include pentaerythritol and trimethylolpropane. Optionally, one or more of the hydroxy groups may be reacted to form an ester or a thioester. In one embodiment, one or more of the hydroxy groups within $R^4$ may be condensed with or attached to an additional group so as to from a bridged species.

In one embodiment, the amine may be represented by the structure

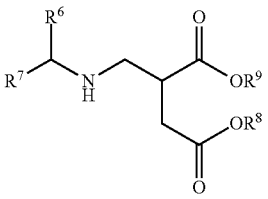

wherein $R^6$ and $R^7$ are independently alkyl groups of 1 to about 6 carbon atoms and $R^8$ and $R^9$ are independently alkyl groups of 1 to about 12 carbon atoms.

The N-hydrocarbyl-substituted γ-aminoester or γ-aminothioester materials disclosed herein may be prepared by a Michael addition of a primary amine, typically having a branched hydrocarbyl group as described above, with an ethylenically unsaturated ester or thio ester of the type described above. The ethylenic unsaturation, in this instance, would be between the β and γ carbon atoms of the ester. Thus, the reaction may occur, for example, as

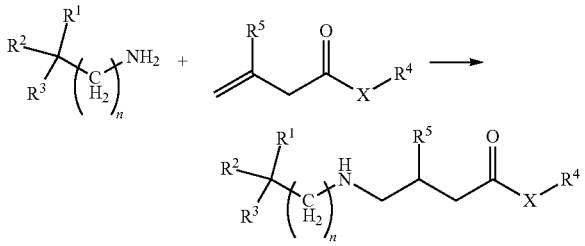

where the X and R groups are as defined above. In one embodiment the ethylenically unsaturated ester may be an ester of itaconic acid. In this structure n may be 0 or 1, $R^1$ may be hydrogen or a hydrocarbyl group, $R^2$ and $R^3$ may independently be hydrocarbyl groups or together form a carbocyclic structure, X is O or S, $R^4$ may be a hydrocarbyl group of 1 to 30 carbon atoms, and $R^5$ may be hydrogen, a hydrocarbyl group, or a group represented by —C(═O)—$R^6$ where $R^6$ is hydrogen, an alkyl group, or —X'—$R^7$, where X' is O or S and $R^7$ is a hydrocarbyl group of 1 to 30 carbon atoms. In one embodiment, the amine reactant is not a tertiary hydrocarbyl (e.g., t-alkyl) primary amine, that is, n is not zero while $R^1$, $R^2$, and $R^3$ are each hydrocarbyl groups.

The amine that may reacting to form the above Michael addition product may be a primary amine, so that the resulting product will be a secondary amine, having a branched R substituent as described above and the nitrogen also being attached to the remainder of the molecule.

The N-hydrocarbyl-substituted δ-aminoester or δ-aminothioester materials disclosed herein may be prepared by reductive amination of the esters of 5-oxy substituted carboxylic acids or 5-oxy substituted thiocarboxylic acids. They may also be prepared by amination of the esters of 5-halogen substituted carboxylic acids or 5-halogen substituted thiocarboxylic acids, or by reductive amination of the esters of 2-amino substituted hexanedioic acids, or by alkylation of the esters of 2-aminohexanedioic acids.

Further detailed description of the N-substituted γ-amino ester and details of its synthesis may be found in WO2014/074335, Lubrizol, May 15, 2014. Further detailed description of the N-substituted δ-amino ester and details of its synthesis may be found in PCT application PCT/US2015/027958, Lubrizol, filed Apr. 28, 2015 and U.S. 61/989,306, filed May 6, 2015.

The amine, of whatever type, will be reacted to neutralize the acidic group(s) on the phosphorus ester component, which will comprise the pyrophosphate ester as described above as well as any orthophosphate esters that may be present.

Amount of the Amine Salt

The amount of the substantially sulfur-free alkyl phosphate amine salt in the lubricant composition may be 0.1 to 5 percent by weight. This amount refers to the total amount of the phosphate amine salt or salts, of whatever structure, both ortho-phosphate and pyrophosphate (with the understanding that at least 30 mole percent of the phosphorus atoms are in an alkyl pyrophosphate salt structure). The amounts of the phosphate amine salts in the pyrophosphate structure may be readily calculated therefrom. Alternative amounts of the alkyl phosphate amine salt may be 0.2 to 3 percent, or 0.2 to 1.2 percent, or 0.5 to 2 percent, or or 0.6 to 1.7 percent, or 0.6 to 1.5 percent, or 0.7 to 1.2 percent by weight. The amount may be suitable to provide phosphorus to the lubricant formulation in an amount of 200 to 3000 parts per million by weight (ppm), or 400 to 2000 ppm, or 600 to 1500 ppm, or 700 to 1100 ppm, or 1100 to 1800 ppm.

Other Components

Detergent

The lubricant formulations described herein may optionally contain an alkaline earth metal detergent, which may optionally be overbased. Detergents, when they are overbased, may also be referred to as overbased or superbased salts. They are generally homogeneous Newtonian systems having by a metal content in excess of that which would be present for neutralization according to the stoichiometry of the metal and the detergent anion. The amount of excess metal is commonly expressed in terms of metal ratio, that is, the ratio of the total equivalents of the metal to the equivalents of the acidic organic compound. Overbased materials may be prepared by reacting an acidic material (such as carbon dioxide) with an acidic organic compound, an inert reaction medium (e.g., mineral oil), a stoichiometric excess of a metal base, and a promoter such as a phenol or alcohol. The acidic organic material will normally have a sufficient number of carbon atoms, to provide oil-solubility.

Overbased detergents may be characterized by Total Base Number (TBN, ASTM D2896), the amount of strong acid needed to neutralize all of the material's basicity, expressed as mg KOH per gram of sample. Since overbased detergents are commonly provided in a form which contains diluent oil, for the purpose of this document, TBN is to be recalculated to an oil-free basis by dividing by the fraction of the detergent (as supplied) that is not oil. Some useful detergents may have a TBN of 100 to 800, or 150 to 750, or, 400 to 700.

While the metal compounds useful in making the basic metal salts are generally any Group 1 or Group 2 metal compounds (CAS version of the Periodic Table of the Elements), the disclosed technology will typically use an alkaline earth such as Mg, Ca, or Ba, typically Mg or Ca, and often calcium. The anionic portion of the salt can be hydroxide, oxide, carbonate, borate, or nitrate.

In one embodiment the lubricant can contain an overbased sulfonate detergent. Suitable sulfonic acids include sulfonic and thiosulfonic acids, including mono- or polynuclear aromatic or cycloaliphatic compounds. Certain oil-soluble sulfonates can be represented by $R^2$-T—$(SO_3^-)_a$ or $R^3$—$(SO_3^-)_b$, where a and b are each at least one; T is a cyclic nucleus such as benzene or toluene; $R^2$ is an aliphatic group such as alkyl, alkenyl, alkoxy, or alkoxyalkyl; $(R^2)$-T typically contains a total of at least 15 carbon atoms; and $R^3$ is an aliphatic hydrocarbyl group typically containing at least 15 carbon atoms. The groups T, $R^2$, and $R^3$ can also contain other inorganic or organic substituents. In one embodiment the sulfonate detergent may be a predominantly linear alkylbenzenesulfonate detergent having a metal ratio of at least 8 as described in paragraphs [0026] to [0037] of US Patent Application 2005065045. In some embodiments the linear alkyl group may be attached to the benzene ring anywhere along the linear chain of the alkyl group, but often in the 2, 3 or 4 position of the linear chain, and in some instances predominantly in the 2 position.

Another overbased material is an overbased phenate detergent. The phenols useful in making phenate detergents can be represented by $(R^1)_a$—Ar—$(OH)_b$, where $R^1$ is an aliphatic hydrocarbyl group of 4 to 400 or 6 to 80 or 6 to 30 or 8 to 25 or 8 to 15 carbon atoms; Ar is an aromatic group such as benzene, toluene or naphthalene; a and b are each at least one, the sum of a and b being up to the number of displaceable hydrogens on the aromatic nucleus of Ar, such as 1 to 4 or 1 to 2. There is typically an average of at least 8 aliphatic carbon atoms provided by the $R^1$ groups for each phenol compound. Phenate detergents are also sometimes provided as sulfur-bridged species.

In one embodiment, the overbased material may be an overbased saligenin detergent. A general example of such a saligenin derivative can be represented by the formula

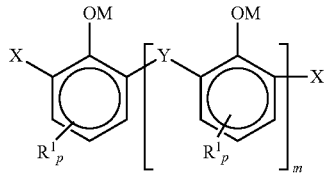

where X is —CHO or —$CH_2OH$, Y is —$CH_2$— or —$CH_2OCH_2$—, and the —CHO groups typically comprise at least 10 mole percent of the X and Y groups; M is hydrogen, ammonium, or a valence of a metal ion (that is, if M is multivalent, one of the valences is satisfied by the illustrated structure and other valences are satisfied by other species such as anions or by another instance of the same structure), $R_1$ is a hydrocarbyl group of 1 to 60 carbon atoms, m is 0 to typically 10, and each p is independently 0, 1, 2, or 3, provided that at least one aromatic ring contains an $R^1$ substituent and that the total number of carbon atoms in all $R^1$ groups is at least 7. When m is 1 or greater, one of the X groups can be hydrogen. Saligenin detergents are disclosed in greater detail in U.S. Pat. No. 6,310,009, with special reference to their methods of synthesis (Column 8 and Example 1) and preferred amounts of the various species of X and Y (Column 6).

Salixarate detergents are overbased materials that can be represented by a compound comprising at least one unit of formula (I) or formula (II) and each end of the compound having a terminal group of formula (III) or (IV):

(I)

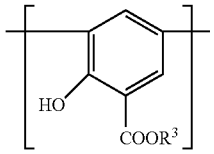

(II)

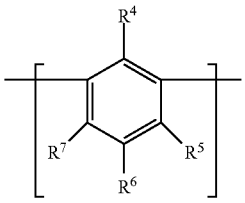

(III)

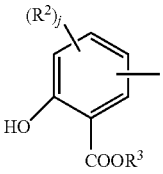

-continued (IV)

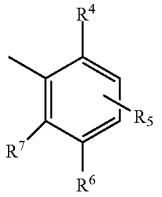

such groups being linked by divalent bridging groups A, which may be the same or different. In formulas (I)-(IV) $R^3$ is hydrogen, a hydrocarbyl group, or a valence of a metal ion; $R^2$ is hydroxyl or a hydrocarbyl group, and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (I) or (III) and at least one of unit (II) or (IV) and the ratio of the total number of units (I) and (III) to the total number of units of (II) and (IV) in the composition is 0.1:1 to 2:1. The divalent bridging group "A," which may be the same or different in each occurrence, includes —$CH_2$— and —$CH_2OCH_2$—, either of which may be derived from formaldehyde or a formaldehyde equivalent (e.g., paraform, formalin). Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate."

Glyoxylate detergents are similar overbased materials which are based on an anionic group which, in one embodiment, may have the structure

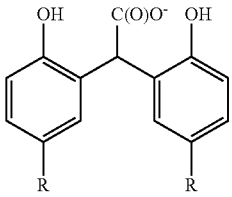

wherein each R is independently an alkyl group containing at least 4 or 8 carbon atoms, provided that the total number of carbon atoms in all such R groups is at least 12 or 16 or 24. Alternatively, each R can be an olefin polymer substituent. Overbased glyoxylic detergents and their methods of preparation are disclosed in greater detail in U.S. Pat. No. 6,310,011 and references cited therein.

The overbased detergent can also be an overbased salicylate, e.g., a calcium salt of a substituted salicylic acid. The salicylic acids may be hydrocarbyl-substituted wherein each substituent contains an average of at least 8 carbon atoms per substituent and 1 to 3 substituents per molecule. The substituents can be polyalkene substituents. In one embodiment, the hydrocarbyl substituent group contains 7 to 300 carbon atoms and can be an alkyl group having a molecular weight of 150 to 2000. Overbased salicylate detergents and their methods of preparation are disclosed in U.S. Pat. Nos. 4,719,023 and 3,372,116.

Other overbased detergents can include overbased detergents having a Mannich base structure, as disclosed in U.S. Pat. No. 6,569,818.

In certain embodiments, the hydrocarbyl substituents on hydroxy-substituted aromatic rings in the above detergents (e.g., phenate, saligenin, salixarate, glyoxylate, or salicylate) are free of or substantially free of $C_{12}$ aliphatic hydrocarbyl groups (e.g., less than 1%, 0.1%, or 0.01% by weight of the substituents are $C_{12}$ aliphatic hydrocarbyl groups). In some embodiments such hydrocarbyl substituents contain at least 14 or at least 18 carbon atoms.

The amount of the overbased detergent, if present in the formulations of the present technology, is typically at least 0.1 weight percent on an oil-free basis, such as 0.2 to 3 or 0.25 to 2, or 0.3 to 1.5 weight percent, or alternatively at least 0.6 weight percent, such as 0.7 to 5 weight percent or 1 to 3 weight percent. Alternatively expressed, the detergent may be in an amount sufficient to provide 0 to 500, or 0 to 100, or 1 to 50 parts by million by weight of alkaline earth metal. Either a single detergent or multiple detergents can be present.

Viscosity Modifier

Another material which may optionally be present is a viscosity modifier. Viscosity modifiers (VM) and dispersant viscosity modifiers (DVM) are well known. Examples of VMs and DVMs may include polymethacrylates, polyacrylates, polyolefins, hydrogenated vinyl aromatic-diene copolymers (e.g., styrene-butadiene, styrene-isoprene), styrene-maleic ester copolymers, and similar polymeric substances including homopolymers, copolymers, and graft copolymers, including polymers having linear, branched, or star-like structures. The DVM may comprise a nitrogen-containing methacrylate polymer or nitrogen-containing olefin polymer, for example, a nitrogen-containing methacrylate polymer derived from methyl methacrylate and dimethylaminopropyl amine. The DVM may alternatively comprise a copolymer with units derived from an α-olefin and units derived from a carboxylic acid or anhydride, such as maleic anhydride, in part esterified with a branched primary alcohol and in part reacted with an amine-containing compound.

Examples of commercially available VMs, DVMs and their chemical types may include the following: polyisobutylenes (such as Indopol™ from BP Amoco or Parapol™ from ExxonMobil); olefin copolymers (such as Lubrizol® 7060, 7065, and 7067, and Lucant® HC-2000, HC-1100, and HC-600 from Lubrizol); hydrogenated styrene-diene copolymers (such as Shellvis™ 40 and 50, from Shell and LZ® 7308, and 7318 from Lubrizol); styrene/maleate copolymers, which are dispersant copolymers (such as LZ® 3702 and 3715 from Lubrizol); polymethacrylates, some of which have dispersant properties (such as those in the Viscoplex™ series from RohMax, the Hitec™ series of viscosity index improvers from Afton, and LZ® 7702, LZ® 7727, LZ® 7725 and LZ® 7720C from Lubrizol); olefin-graft-polymethacrylate polymers (such as Viscoplex™ 2-500 and 2-600 from RohMax); and hydrogenated polyisoprene star polymers (such as Shellvis™ 200 and 260, from Shell). Viscosity modifiers that may be used are described in U.S. Pat. Nos. 5,157,088, 5,256,752 and 5,395,539. The VMs and/or DVMs may be used in the functional fluid at a concentration of up to 50% or to 20% by weight, depending on the application. Concentrations of 1 to 20%, or 1 to 12%, or 3 to 10%, or alternatively 20 to 40%, or 20 to 30% by weight may be used.

Dispersant

Another material which may optionally be present is a dispersant. Dispersants are well known in the field of lubricants and include primarily what is known as ashless dispersants and polymeric dispersants. Ashless dispersants are so-called because, as supplied, they do not contain metal and thus do not normally contribute to sulfated ash when added to a lubricant. However they may, of course, interact with ambient metals once they are added to a lubricant which includes metal-containing species. Ashless dispersants are characterized by a polar group attached to a relatively high molecular weight hydrocarbon chain. Typical ashless dispersants include N-substituted long chain alkenyl succinimides, having a variety of chemical structures including typically

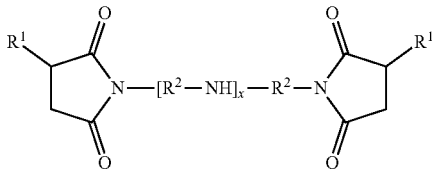

where each $R^1$ is independently an alkyl group, frequently a polyisobutylene group with a molecular weight ($M_n$) of 500-5000 based on the polyisobutylene precursor, and $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. In the above structure, the amine portion is shown as an alkylene polyamine, although other aliphatic and aromatic mono- and polyamines may also be used. Also, a variety of modes of linkage of the $R^1$ groups onto the imide structure are possible, including various cyclic linkages. The ratio of the carbonyl groups of the acylating agent to the nitrogen atoms of the amine may be 1:0.5 to 1:3, and in other instances 1:1 to 1:2.75 or 1:1.5 to 1:2.5. Succinimide dispersants are more fully described in U.S. Pat. Nos. 4,234,435 and 3,172,892 and in EP 0355895.

Another class of ashless dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of ashless dispersant is Mannich bases. These are materials formed by the condensation of a higher molecular weight alkyl substituted phenol, an alkylene polyamine, and an aldehyde such as formaldehyde. They are described in more detail in U.S. Pat. No. 3,634,515.

Other dispersants include polymeric dispersant additives, which may be hydrocarbon-based polymers which contain polar functionality to impart dispersancy characteristics to the polymer.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403.

The amount of the dispersant in a fully formulated lubricant of the present technology may be at least 0.1% of the lubricant composition, or at least 0.3% or 0.5% or 1%, and in certain embodiments at most 9% or 8% or 6% or often 4% or 3% or 2% by weight.

Other conventional components may also be included. Examples include friction modifiers, which are well known to those skilled in the art. A list of friction modifiers that may be used is included in U.S. Pat. Nos. 4,792,410, 5,395,539, 5,484,543 and 6,660,695. U.S. Pat. No. 5,110,488 discloses metal salts of fatty acids and especially zinc salts, useful as friction modifiers. A list of supplemental friction modifiers that may be used may include:

| | |
|---|---|
| fatty phosphites | borated alkoxylated fatty amines |
| fatty acid amides | metal salts of fatty acids |
| fatty epoxides | sulfurized olefins |
| borated fatty epoxides | fatty imidazolines |
| fatty amines | condensation products of carboxylic |
| glycerol esters | acids and polyalkylene-polyamines |
| borated glycerol esters | metal salts of alkyl salicylates |
| alkoxylated fatty amines | amine salts of alkylphosphoric acids |
| oxazolines | ethoxylated alcohols |
| hydroxyalkyl amides | imidazolines |
| dialkyl tartrates | polyhydroxy tertiary amines |
| molybdenum compounds | and mixtures of two or more thereof. |

The amount of friction modifier, if present, may be 0.05 to 5 percent by weight, or 0.1 to 2 percent, or 0.1 to 1.5 percent by weight, or 0.15 to 1 percent, or 0.15 to 0.6 percent.

Another optional component may be an antioxidant. Antioxidants encompass phenolic antioxidants, which may be hindered phenolic antioxidants, one or both ortho positions on a phenolic ring being occupied by bulky groups such as t-butyl. The para position may also be occupied by a hydrocarbyl group or a group bridging two aromatic rings. In certain embodiments the para position is occupied by an ester-containing group, such as, for example, an antioxidant of the formula

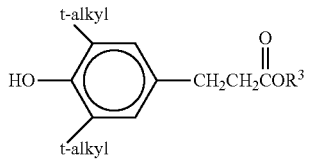

wherein $R^3$ is a hydrocarbyl group such as an alkyl group containing, e.g., 1 to 18 or 2 to 12 or 2 to 8 or 2 to 6 carbon atoms; and t-alkyl can be t-butyl. Such antioxidants are described in greater detail in U.S. Pat. No. 6,559,105.

Antioxidants also include aromatic amines. In one embodiment, an aromatic amine antioxidant can comprise an alkylated diphenylamine such as nonylated diphenylamine or a mixture of a di-nonylated and a mono-nonylated diphenylamine. If an aromatic amine is used as a component of the above-described phosphorus compound, it may itself impart some antioxidant activity such that the amount of any further antioxidant may be appropriately reduced or even eliminated.

Antioxidants also include sulfurized olefins such as mono- or disulfides or mixtures thereof. These materials generally have sulfide linkages of 1 to 10 sulfur atoms, e.g., 1 to 4, or 1 or 2. Materials which can be sulfurized to form the sulfurized organic compositions of the present invention include oils, fatty acids and esters, olefins and polyolefins made thereof, terpenes, or Diels-Alder adducts. Details of methods of preparing some such sulfurized materials can be found in U.S. Pat. Nos. 3,471,404 and 4,191,659.

Molybdenum compounds can also serve as antioxidants, and these materials can also serve in various other functions, such as antiwear agents or friction modifiers. U.S. Pat. No. 4,285,822 discloses lubricating oil compositions containing a molybdenum- and sulfur-containing composition prepared by combining a polar solvent, an acidic molybdenum compound and an oil-soluble basic nitrogen compound to form a molybdenum-containing complex and contacting the complex with carbon disulfide to form the molybdenum- and sulfur-containing composition.

Typical amounts of antioxidants will, of course, depend on the specific antioxidant and its individual effectiveness, but illustrative total amounts can be 0 to 5 percent by weight, or 0.01 to 5 percent by weight, or 0.15 to 4.5 percent, or 0.2 to 4 percent, or 0.2 to 1 percent or 0, 2 to 0.7 percent.

Another optional additive is an antiwear agent. Examples of anti-wear agents include phosphorus-containing antiwear/extreme pressure agents in addition to those described above; such as metal-containing or non-metal thiophosphates, phosphoric acid esters and salts, such as amine salts, thereof, phosphorus-containing carboxylic acids, esters, ethers, and amides; phosphonates; and phosphites. In certain embodiments such phosphorus antiwear agent may be present in an amount to deliver 0.001 to 2 percent phosphorus, or 0.015 to 1.5, or 0.02 to 1, or 0.1 to 0.7, or 0.01 to 0.2, or 0.015 to 0.15, or 0.02 to 0.1, or 0.025 to 0.08 percent phosphorus. A material used in some applications may be a zinc dialkyldithiophosphate (ZDP). Non-phosphorus-containing anti-wear agents include borate esters (including borated epoxides), dithiocarbamate compounds, molybdenum-containing compounds, and sulfurized olefins.

Other materials that may be present include tartrate esters, tartramides, and tartrimides. Examples include oleyl tartrimide (the imide formed from oleylamine and tartaric acid) and oleyl diesters (from, e.g., mixed $C_{12}$-16 alcohols). Other related materials that may be useful include esters, amides, and imides of other hydroxy-carboxylic acids in general, including hydroxy-polycarboxylic acids, for instance, acids such as tartaric acid, citric acid, lactic acid, glycolic acid, hydroxy-propionic acid, hydroxyglutaric acid, and mixtures thereof. These materials may also impart additional functionality to a lubricant beyond antiwear performance. These materials are described in greater detail in US Publication 2006-0079413 and PCT publication WO2010/077630. Such derivatives of (or compounds derived from) a hydroxy-carboxylic acid, if present, may typically be present in the lubricating composition in an amount of 0.01 to 5 weight %, or 0.05 to 5 or 0.1 weight % to 5 weight %, or 0.1 to 1.0 weight percent, or 0.1 to 0.5 weight percent, or 0.2 to 3 weight %, or greater than 0.2 weight % to 3 weight %.

Other additives that may optionally be used in lubricating oils, in their conventional amounts, include pour point depressing agents, extreme pressure agents, dimercaptothiadiazole compounds, color stabilizers and anti-foam agents.

Extreme pressure agents include sulfur-containing extreme pressure agents and chlorosulfur-containing EP agents. Examples of such EP agents include organic sulfides and polysulfides such as dibenzyldisulfide, bis-(chlorobenzyl)disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; metal thiocarbamates such as zinc dioctyldithiocarbamate; the zinc salts of a phosphorodithioic acid; amine salts of sulfur-containing alkyl and dialkyl-phosphoric acids, including, for example, the amine salt of the reaction product of a dialkyldithiophosphoric acid with propylene oxide; dithiocarbamic acid derivatives; and mixtures thereof. The amount of extreme pressure agent, if present, may be 0.1% to 10%, or 0.5% to 10%, or 1% to 7%, or 2% to 6% by weight.

Another additive that may optionally be present is a dimercaptothiadiazole (DMTD) derivative, which may be used as a copper corrosion inhibitor. The dimercaptothiadiazole derivatives typically are soluble forms or derivatives of DMTD. Materials which can be starting materials for the preparation of oil-soluble derivatives containing the dimercaptothiadiazole nucleus can include 2,5-dimercapto-[1,3,4]-thiadiazole, 3,5-dimercapto-[1,2,4]-thiadiazole, 3,4-dimercapto-[1,2,5]-thiadiazole, and 4,5-dimercapto-[1,2,3]-thiadiazole. Of these the most readily available is 2,5-dimercapto-[1,3,4]-thiadiazole. Various 2,5-bis-(hydrocarbon dithio)-1,3,4-thiadiazoles and 2-hydrocarbyl-dithio-5-mercapto-[1,3,4]-thiadiazoles may be used. The hydrocarbon group may be aliphatic or aromatic, including cyclic, alicyclic, aralkyl, aryl and alkaryl. Similarly, carboxylic esters of DMTD are known and may be used, as can condensation products of alpha-halogenated aliphatic monocarboxylic acids with DMTD or products obtained by reacting DMTD with an aldehyde and a diaryl amine in molar proportions of from about 1:1:1 to about 1:4:4. The DMTD materials may also be present as salts such as amine salts. In other embodiments, the DMTD compound may be the reaction product of an alkyl phenol with an aldehyde such as formaldehyde and a dimercaptothiadiazole. Another useful DMTD derivative is obtained by reacting DMTD with an oil-soluble dispersant, such as a succinimide dispersant or a succinic ester dispersant.

The amount of the DMTD compound, if present, may be 0.01 to 5 percent by weight of the composition, depending in part on the identity of the particular compound, e.g., 0.01 to 1 percent, or 0.02 to 0.4 or 0.03 to 0.1 percent by weight. Alternatively, if the DMTD is reacted with a nitrogen-containing dispersant, the total weight of the combined product may be significantly higher in order to impart the same active DMTD chemistry; for instance, 0.1 to 5 percent, or 0.2 to 2 or 0.3 to 1 or 0.4 to 0.6 percent by weight.

The disclosed technology provides a method of lubricating a mechanical device, comprising supplying thereto a lubricant formulation as described herein. The mechanical device may comprise a gear as in a gearbox of a vehicle (e.g., a manual transmission) or in an axle or differential. It may also be useful in engine lubricants, hydraulic fluids, transmission fluids, tractor hydraulic fluids, industrial lubricant applications, and greases. Lubricated gears may include hypoid gears in a rear drive axle, where the lubricants disclosed herein may provide wear protection for operation under low-speed, high-torque conditions.

As used herein, the term "condensation product" is intended to encompass esters, amides, imides and other such materials that may be prepared by a condensation reaction of an acid or a reactive equivalent of an acid (e.g., an acid halide, anhydride, or ester) with an alcohol or amine, irrespective of whether a condensation reaction is actually performed to lead directly to the product. Thus, for example, a particular ester may be prepared by a transesterification reaction rather than directly by a condensation reaction. The resulting product is still considered a condensation product.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

It is known that some of the materials described herein may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

The invention herein may be better understood with reference to the following examples.

EXAMPLES

Example 1

A phosphate composition is prepared by stirring 4-methyl-2-pentanol and then adding in phosphorus pentoxide over 2 hours under nitrogen, to a mole ratio of 3:1 (taking phosphorus pentoxide to be $P_2O_5$). The initial temperature is 40° C., and the temperature rises due to the exothermic nature of the reaction; the temperature during addition is maintained at 50° C. or below until the addition is complete. Thereafter the temperature is allowed to rise to 70° C., and the mixture is maintained at 70° C. for 4 hours. Thereafter, 1.82 moles (relative amount) of ethylhexylamine is added at about 60° C. and the mixture is maintained at 75° C. for 3-4 hours. The product is filtered through filter aid.

The resulting product is analyzed by phosphorus NMR. The product is found to have about 56 percent of the phosphorus atoms in a pyrophosphate structure, as evidenced by integrating the peaks at approximately −11 to −17 ppm shift, as measured on the amine salt. The remainder of the phosphorus exists as amine salt of orthophosphate structures (e.g., mono- or di-esters) or a small amount as phosphoric acid (which is not removed from the mixture).

In multiple runs of the synthesis as in Example 1, the amount of pyrophosphate phosphorus is found to vary from 50 to 60 percent; somewhat lower values are characteristic of reaction at higher temperatures (e.g., addition of $P_2O_5$ at 55-60° C. with subsequent heating to 85° C.), and somewhat higher values are characteristic of reaction at lower temperatures.

Example 2

Part 1. A phosphate composition is prepared in a 3 L 7-neck round-bottom flask equipped with an overhead stirrer, thermocouple, vapor-space nitrogen purge, Dean-Stark trap with a dry-ice/acetone condenser, powder screw feeder, and wand-type high-shear mixer. Phosphorus pentoxide (752.5 g, 5.30 moles) is placed in the powder screw feeder, and 4-methyl-2-pentanol (1250 g, 12.23 moles) is added to the flask so as to cover the stirrer blade and bottom portion of the high-speed mixer wand. The 4-methyl-2-penentanol is heated to 40° C. and the $P_2O_5$ is added in a slow, controlled fashion, with stirring and mixing, while the reaction mixture exothermically warms to 60° C. The balance of the $P_2O_5$ is added for a total addition time of 1-¾ hours, while the temperature is maintained at about 60° C. by external cooling, and thereafter the mixture is maintained at 60° C. for an additional 1-½ hours, while stirring and mixing. Volatile components are removed by vacuum stripping at 60° C., the pressure being gradually reduced to 6.6 kPa (50 mm Hg) over ½ hour. The resulting phosphate/pyrophosphate intermediate is calculated to have an equivalent weight (per phosphorus atom) of 183.7 g/P.

Part 2. A portion of the acid phosphate/pyrophosphate intermediate from step 1 (1200 g, 6.532 equivalents P) is placed in a separate 3 L flask with stirrer and is heated to 40° C. 2-Ethylhexylamine (802.4 g, 6.208 equivalents) is added dropwise by an addition funnel, allowing the temperature to rise to 60° C., maintained at that temperature by external cooling. After about half of the 2-ethylhexylamine is added, 349.9 g of an API group II oil is added as a diluent, after which the remaining 2-ethylhexylamine is added at 60° C., the entire addition requiring about 1-⅓ hours, after which stirring is continued for 25 minutes. The material is vacuum stripped at 60° C., 6.6 kPa (50 mm Hg) for 60 minutes until bubbling in the liquid is no longer apparent. The resulting product is a clear, free-flowing liquid having a viscosity of about 600 $mm^2/s$ (cSt) at 40° C. Phosphorus NMR shows the product to have about 69.5 percent of P atoms in the pyrophosphate form, the balance being about 12.5% monoalkyl orthophosphate, 11.8% dialkyl orthophosphate, 5.2% polyphosphates, and 0.5% phosphoric acid.

In multiple runs of the synthesis as in Example 2 at molar ratios of 4-methyl-2-pentanol to $P_2O_5$ of 2.25:1 to 2.40:1, the amount of pyrophosphate phosphorus is found to vary from about 65 to about 75 percent.

Reference Example 3

A conventional amine phosphate salt is prepared in a similar manner to that of Example 1, except that the alcohol reacted with the phosphorus pentoxide is isooctyl alcohol, a primary alcohol. Analysis of the product indicates that about 10 percent or less of the phosphorus atoms are in a pyrophosphate structure, the remainder being in orthophosphate or phosphoric acid structures.

Examples 4-13

A series of base compositions of differing viscosities are prepared in mixtures of polyalphaolefin oils (PAO) of different viscosities. The base compositions are characteristic of those that would be used as an automotive axle lubricant. They contain the following components (presented on an oil free basis):

| | |
|---|---|
| Dispersants (mixture of roughly equal amounts of borated succinimide dispersant and succinimide/ester dispersant incorporating dimercaptothiadiazole)[f] | 1.18% |
| Sulfurized olefin extreme pressure agents | 4.6% |
| Dimercaptothiadiazole-type corrosion inhibitor | 0.2% |
| Imidazoline-type friction modifier | 0.035% |
| Commercial antifoam agent | 0.031% |
| Mineral diluent oil associated with the above components | about 1% |
| Phosphorus compounds | as in table below |
| Polyalphaolefin (PAO) oils, as in table below | balance to = 100% |

Lubricant formulations are prepared for examples 4-13 as follows:

| Example | 4 | 5* | 6 | 7* | 8 | 9* | 10 | 11* | 12 | 13* |
|---|---|---|---|---|---|---|---|---|---|---|
| product of Ex. 1, % | 0.71 | | 0.92 | | 0.94 | | 0.92 | | 1.10 | |
| product of Ref Ex. 2, % | | 0.91 | | 1.17 | | 1.17 | | 1.17 | | 1.43 |
| Phosphorus conc., ppm[c] | 700 | 700 | 900 | 900 | 900 | 900 | 900 | 900 | 1100 | 1100 |
| PAO 4 cSt [a] | 73 | 73 | 100 | 100 | | | 34 | 34 | 73 | 73 |
| PAO 6 cSt | | | | | 20 | 20 | | | | |
| PAO 8 cSt | | | | | 80 | 80 | | | | |
| PAO 100 cSt | 27 | 27 | | | | | 66 | 66 | 27 | 27 |
| KV_100 [b] | 9 | 9 | 4 | 4 | 7 | 7 | 31 | 31 | 9 | 9 |

*A comparative or reference example

[a] Amounts of oil are in relative parts by weight. cSt refers to kinematic viscosity at 100° C., in $mm^2/s$

[b] Kinematic viscosity of the entire formulation at 100° C., $mm^2/s$

[c]P concentrations are target values, by formulation.

The lubricant formulations of Examples 4 through 13 are subjected to a hypoid gear durability test. The test uses a light duty hypoid gear rear drive axle. The test is a 2-stage steady state test typical of (but not necessarily identical to) ASTM D6121. Stage 1 is a 65 minute break-in stage run at high speed and low load to allow break-in of the gears before the durability stage is run. Wheel speed is controlled to 682 rpm and wheel torque is controlled to 508 Nm per wheel during this conditioning phase. Stage 2 is a 27 hour durability phase to evaluate the lubricant's ability to protect the gears from failure mode, evaluated in accordance with ASTM D6121. Wheel speed is controlled to 124 rpm and wheel torque is controlled to 2237 Nm per wheel. Bulk oil temperature is measured via an immersed thermocouple and allowed to warm up unassisted during the conditioning phase and limited to 135° C. during both phases of the test using spray water to the outside of the axle housing. The speed and torques are smoothly ramped over 2-5 minutes between the conditioning and the test states. Test components are removed and rated by a Test Monitoring Center-calibrated rater according to GL-5 L-37 rating standards. A score of 10 is the best. Minimum passing criteria per ASTM D6121 are shown in parentheses.

| | Example | | | | | | | | | |
|---|---|---|---|---|---|---|---|---|---|---|
| (pass value) | 4 | 5* | 6 | 7* | 8 | 9* | 10 | 11* | 12 | 13* |
| Pinion rating | 8 | 5 | 8 | 7 | 8 | 5 | 8 | 6 | 8 | 3 |
| wear (5) | | | | | | | | | | |
| rippling (8) | 10 | 10 | 10 | 6 | 10 | 10 | 10 | 6 | 10 | 9 |
| ridging (8) | 9 | 6 | 10 | 6 | 10 | 4 | 10 | 6 | 9 | 4 |
| scoring (10) | 10 | 9 | 8 | 10 | 10 | 10 | 10 | 10 | 10 | 7 |
| Ring rating | 9 | 7 | 9 | 7 | 9 | 7 | 9 | 8 | 9 | 4 |
| wear (5) | | | | | | | | | | |
| rippling (8) | 10 | 10 | 10 | 10 | 10 | 10 | 10 | 10 | 10 | 10 |
| ridging (8) | 10 | 7 | 10 | 7 | 10 | 4 | 10 | 9 | 9 | 4 |
| scoring (10) | 10 | 10 | 10 | 10 | 10 | 10 | 10 | 10 | 10 | 7 |

The results show excellent wear performance at low phosphorus levels and also in low viscosity formulations.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as optionally modified by the word "about." It is to be understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the essential or basic and novel characteristics of the composition or method under consideration. The expression "consisting of" or "consisting essentially of,"

when applied to an element of a claim, is intended to restrict all species of the type represented by that element, notwithstanding the presence of "comprising" elsewhere in the claim.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

What is claimed is:

1. A lubricant composition comprising an oil of lubricating viscosity and about 0.5 to about 5 percent by weight of a substantially sulfur-free alkyl phosphate amine salt represented by formula (I) or (II):

(I)

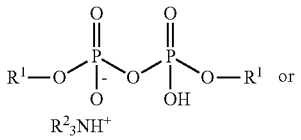

(II)

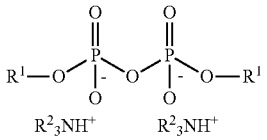

wherein each $R^1$ is independently a secondary alkyl group of about 4 to about 12 carbon atoms and each $R^2$ is independently hydrogen or a hydrocarbyl group or an ester-containing group, and at least one $R^2$ group is a hydrocarbyl group or an ester-containing group; or wherein the —OH group is replaced by an —$OR^1$ group, or wherein one or more —$OR^1$ groups are replaced by —OH groups, or wherein an $R^1$ group is replaced by a phosphorus-containing group, and wherein at least about 40 mole percent of the phosphorus atoms are in an-alkyl pyrophosphate salt structure; wherein at least about 80 mole percent of the alkyl groups are secondary alkyl groups of about 3 to about 12 carbon atoms.

2. The lubricant composition of claim 1 wherein the alkyl phosphate amine salt is prepared or preparable by the reaction of phosphorus pentoxide with a secondary alcohol having about 4 to about 12 carbon atoms and reacting the product thereof with an amine.

3. The lubricant composition of claim 2 wherein the amine is a hydrocarbyl amine.

4. The lubricant composition of claim 3 wherein the amine comprises 2-ethylhexylamine.

5. The lubricant composition of claim 2 wherein the amine comprises an N-hydrocarbyl-substituted γ- or δ-amino(thio)ester or γ- or δ-amino ester.

6. The lubricant composition of claim 5 wherein the aminoester is represented by the formula

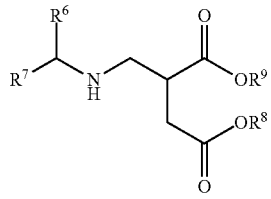

wherein $R^6$ and $R^7$ are independently alkyl groups of 1 to about 6 carbon atoms and $R^8$ and $R^9$ are independently alkyl groups of 1 to about 12 carbon atoms.

7. The lubricant composition of claim 2 wherein, in the reaction to prepare the alkyl phosphate amine salt, the phosphorus pentoxide is reacted with about 2 to about 3.1 moles per mole of $P_2O_5$, of the secondary alcohol at a temperature of about 30° C. to about 60° C.

8. The lubricant composition of claim 2 wherein, in the reaction to prepare the alkyl phosphate amine salt, the phosphorus pentoxide is reacted with about 2.2 to about 2.4 moles, per mole of $P_2O_5$, of the secondary alcohol at a temperature of about 50° C. to about 60° C.

9. The lubricant composition of claim 1 wherein the alkyl phosphate amine salt comprises up to about 60 mole percent of the phosphorus atoms in mono- or di-alkyl-orthophosphate salt structures.

10. The lubricant composition of claim 1 wherein the alkyl phosphate amine salt comprises at least about 50 to about 80 mole percent of the phosphorus atoms in an alkyl pyrophosphate salt structure.

11. The lubricant composition of claim 1 wherein the alkyl group or groups of the alkylphosphate structure have a methyl branch at the α-position.

12. The lubricant composition of claim 1 wherein the alkyl group or groups of the alkylphosphate structure comprise 4-methylpent-2-yl groups.

13. The lubricant composition of claim 1 wherein the oil of lubricating viscosity has a kinematic viscosity at 100° C. by ASTM D445 of about 3 to about 7.5 $mm^2/s$.

14. The lubricant composition of claim 1 wherein the oil of lubricating viscosity comprises a poly alpha olefin having a kinematic viscosity at 100° C. by ASTM D445 of about 3 to about 7.5.

15. The lubricant composition of claim 1 further comprising an overbased alkaline earth metal detergent in an amount to provide 1 to about 500 parts by million by weight alkaline earth metal.

16. The lubricant composition of claim 1 optionally comprising 5 to about 30 percent by weight of a polymeric viscosity index modifier.

17. The lubricant composition of claim 1 further comprising a sulfur-containing extreme-pressure agent.

18. The lubricant composition of claim 1 further comprising a dimercaptothiadiazole derivative.

19. A composition prepared by admixing the components of claim 1.

20. A method of lubricating a mechanical device comprising supplying thereto the lubricant composition of claim 1.

21. The method of claim 20 wherein the mechanical device comprises a gear.

22. The method of claim 21 wherein the mechanical device comprises an axle or a manual transmission.

23. A method of preparing a substantially sulfur-free alkyl phosphate amine salt wherein at least about 40 mole percent of the phosphorus atoms are in an alkyl pyrophosphate salt structure, comprising:

reacting phosphorus pentoxide with about an equivalent amount of a secondary alcohol or a mixture of secondary alcohols having about 4 to about 12 carbon atoms, at a temperature of about 40 to about 60° C. to form a diester having a pyrophosphate structure, and reacting the diester with an amine to form an alkyl phosphate amine salt represented by formula (I) or (II):

(I)

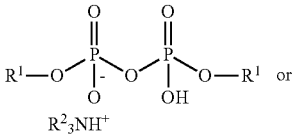

-continued (II)

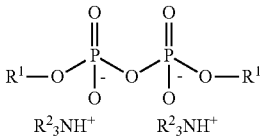

wherein each $R^1$ is independently a secondary alkyl group of about 4 to about 12 carbon atoms and each $R^2$ is independently hydrogen or a hydrocarbyl group or an ester-containing group, and at least one $R^2$ group is a hydrocarbyl group or an ester-containing group; or wherein the —OH group is replaced by an —$OR^1$ group, or wherein one or more —$OR^1$ groups are replaced by —OH groups, or wherein an $R^1$ group is replaced by a phosphorus-containing group.

24. The method of claim 23 wherein the phosphorus pentoxide is reacted with about 2.2 to about 2.4 moles, per mole of $P_2O_5$, of the secondary alcohol or mixture of secondary alcohols at a temperature of about 50° C. to about 60° C.

* * * * *